United States Patent [19]

York

[11] 4,396,490

[45] Aug. 2, 1983

[54] OIL SHALE RETORTING METHOD AND APPARATUS

[75] Inventor: Earl D. York, Englewood, Colo.

[73] Assignee: Standard Oil Company (Indiana), Chicago, Ill.

[21] Appl. No.: 208,163

[22] Filed: Nov. 19, 1980

[51] Int. Cl.[3] ..... C10G 1/00; C10G 49/10

[52] U.S. Cl. ..... 208/11 R; 201/31; 201/108; 201/121

[58] Field of Search ..... 208/11 R; 202/108, 109, 202/120, 121

[56] References Cited

U.S. PATENT DOCUMENTS

| | | | |
|---|---|---|---|
| 3,597,347 | 8/1971 | Ellington, Jr. | 208/11 R |
| 3,655,518 | 4/1972 | Schmalfeld et al. | 208/11 R X |
| 3,703,442 | 11/1972 | Rammler et al. | 208/11 R X |

*Primary Examiner*—Delbert E. Gantz
*Assistant Examiner*—Glenn Caldarola
*Attorney, Agent, or Firm*—Thomas W. Tolpin; William T. McClain; William H. Magidson

[57] ABSTRACT

Disclosed is an improved method for the retorting of oil shale comprising passing feed comprising oil shale to a contacting zone wherein the feed oil shale is contacted with heat transfer medium to heat said shale to retorting temperature. Retorting of the feed oil shale is substantially effected to form fluid material having heating value and forming partially spent oil shale comprising inorganic and carbonaceous material. At least a portion of the partially spent oil shale is passed to a combustion zone wherein the partially spent oil shale is contacted with oxidizing gas comprising oxygen to substantially combust carbonaceous material and forming spent oil shale. At least a portion of the spent shale is passed to a cooling zone to remove heat from the spent shale and at least a portion of the spent shale from the cooling zone is recycled to the contacting zone.

13 Claims, 1 Drawing Figure

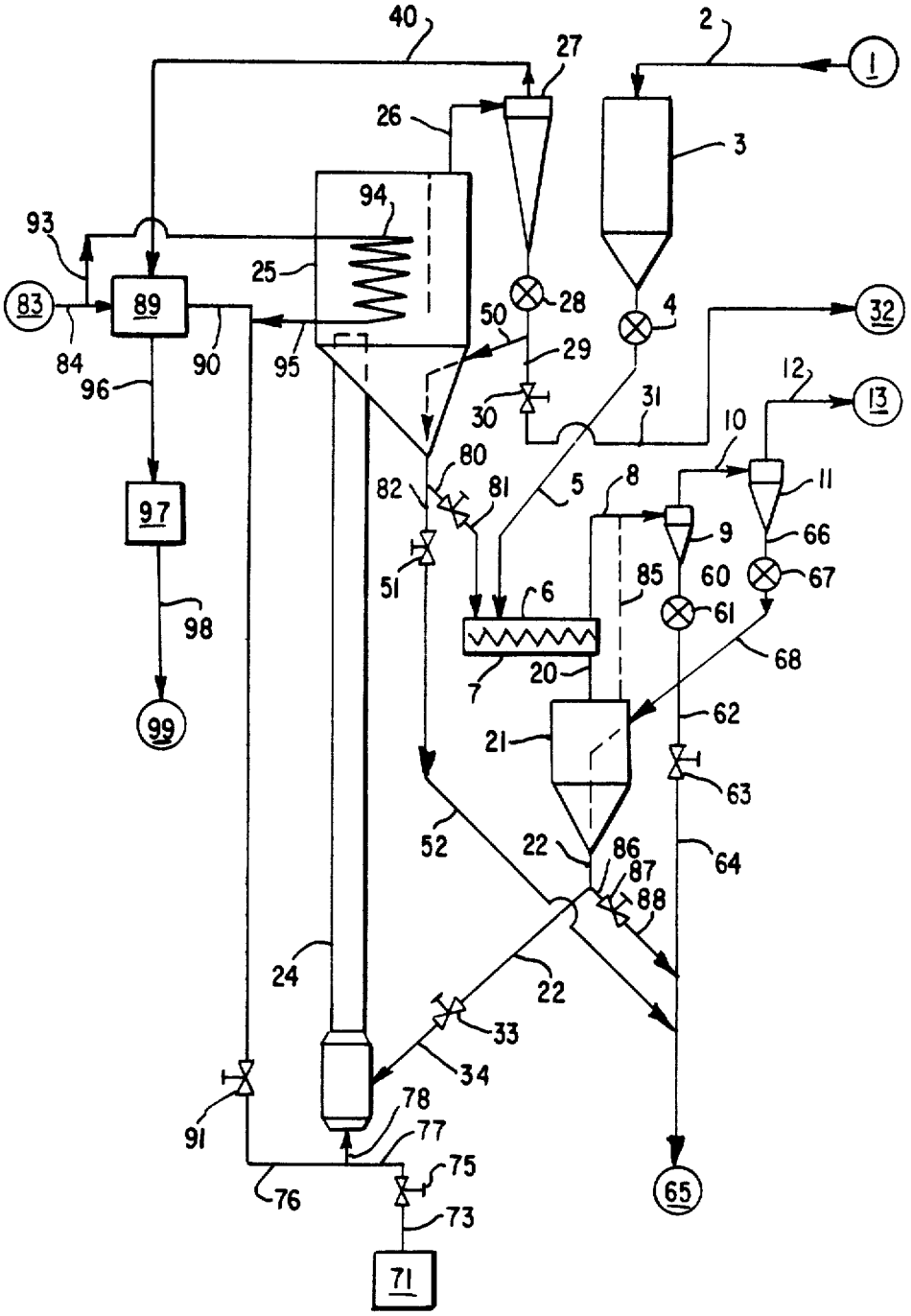
40
27
2
1
26
3
94
93
25
28
4
83
89
50
32
84
90
95
29
12
96
30
31
13
10
80
82
81
5
8
11
97
9
66
51
60
67
85
6
61
98
68
20
7
99
62
21
63
52
22
86
64
87
88
24
22
33
34
91
78
77
75
76
65
73
71

OIL SHALE RETORTING METHOD AND APPARATUS

BACKGROUND

This invention relates to the retorting of oil shale. More specifically, this invention relates to an improved process and apparatus for the retorting of oil shale, the production of spent oil shale having improved cementation properties, and the recovery of energy from the process.

The term "oil shale" refers to sedimentary deposits containing organic materials which can be converted to shale oil. Oil shale can be found in various places throughout the world, especially in the United States in Colorado, Utah, and Wyoming. Some especially important deposits can be found in the Green River formation in the Piceance Basin, Garfield and Rio Blanco counties, in Northwestern Colorado.

Oil shale contains organic material called kerogen which is a solid carbonaceous material from which shale oil can be produced. Commonly oil shale deposits have variable richness of kerogen content, the oil shale generally being stratified in horizontal layers. Upon heating oil shale to a sufficient temperature, kerogen is decomposed and liquids and gases are formed. These fluids contain heating values and comprise shale oil, carbon monoxide, carbon dioxide, hydrogen, light hydrocarbon gases, water, hydrogen sulfide, and others. Oil shale can be retorted to form a hydrocarbon liquid either by in situ or surface retorting. In surface retorting, oil shale is mined from the ground, brought to the surface, crushed, and placed in vessels where it is contacted with hot heat transfer medium, such as hot shale or gases, or mixtures thereof, for heat transfer. The resulting high temperatures cause shale oil to be freed from the oil shale forming a partially spent oil shale comprising inorganic material and carbonaceous material such as coke. The coke may be deposited on the surface of the shale particles and also within the shale particles The carbonaceous material can be burned by contact with oxygen at oxidation temperatures to recover heat and to form a spent oil shale relatively free of carbon. Spent retorted oil shale which has been depleted in carbonaceous material is removed from the reactor and discarded. Some well-known methods of surface retorting are the Tosco, Lurgi, and Paraho processes and fluid bed retorting, among others.

In the Lurgi type retort, raw fresh shale is fed into a mixer wherein it is contacted with hot spent or partially spent shale. The combined oil shales are then fed into a zone for additional residence time. Shale oil which has been retorted from the oil shale is separated from the shale. The oil is recovered and the spent and partially spent shale is passed to a zone wherein carbon is burned off the shale. This can be done by introducing oxygen containing gas such as air or diluted oxygen, and sometimes additional fuel to the zone to combust the carbon. A preferred method is to pass the spent and partially spent shale, and air or air and fuel upwardly through a vertical elongated zone such as a lift pipe. After oxidation, a portion of the spent shale is then removed from the flue gas from said zone, for example by electrostatic precipitators, and used for the manufacture of solid masses. Another portion of the spent shale is fed to the mixer to transfer heat to fresh oil shale. This process is more fully described in U.S. Pat. No. 3,655,518 which is incorporated by reference and made a part hereof.

In fluid bed retorting, crushed shale is contacted with hot spent shale and/or hot gases in a fluid bed. The fluid bed may be an elongated vertical zone wherein solids are introduced at or near the bottom and maintained in a fluidized state by high gas velocity. However, fluid bed retort may have many configurations. High temperatures cause oil shale and partially spent oil shale to be formed. Solids are separated from liquid and gaseous products, and partially spent oil shale containing carbonaceous material is passed to a fluidized oxidation zone to burn the carbonaceous material and form spent oil shale relatively free of carbon for recycle or for disposal. Mitchell et al., U.S. Pat. Nos. 4,183,800 and 4,133,739; Tamm et al., U.S. Pat. No. 4,125,453 and Langlois et al., U.S. Pat. No. 4,087,347 are just a few patents which describe fluid bed retorting and are incorporated by reference and made a part hereof.

Knepper et al., U.S. Pat. No. 4,120,355 and Watson et al., U.S. Pat. No. 4,131,416, teach the introduction of aqueous slurries of spent oil shale from surface retorting into spent subterranean in situ oil shale retorts to form mechanically strong structures. These structures can prevent surface subsidence above the retort, and prevent leaching of chemicals from the mass of rubblized spent shale underground.

O'Neal, U.S. Pat. No. 3,459,003 teaches the use of slurries of spent shale from surface retorting and water, and in some cases cement, for forming of a competent mass having structural strength underground.

Fondriest, U.S. Ser. No. 803,730, filed June 6, 1977, teaches the use of concrete, sometimes containing spent oil shale from surface retorting, to fill underground voids formed from the mining of oil shale or coal. The concrete forms load bearing pillars so that support pillars of hydrocarbonaceous material can be removed.

In order for a slurry of water and spent oil shale from surface retorting to be suitable to form a mechanically strong and environmentally acceptable structure, the spent oil shale preferably has certain properties. The spent shale should contain less than about 0.5 weight percent carbon, still more preferably less than about 0.2 weight percent carbon, so that the spent shale can be suitably wetted by water. Preferably at least about 90 weight percent of the spent shale should be smaller than about 150 mesh, more preferably smaller than about 200 mesh. Also, the spent shale desirably contains a reasonable content of inorganic oxides. This can be accomplished by converting carbonates in the partially spent shale to oxides by thermal decomposition.

In order to assure good heat contact between fresh oil shale feed and spent shale recycle, and good grinding action due to recirculation in the retort contacting zone resulting in fine particle size of partially spent and spent shale, high recycle rates of spent shale to feed shale are desirable.

It is an object of this invention to provide an improved method and apparatus for the retorting of oil shale while producing a fine spent shale with improved concentration properties due primarily to its fineness.

It is an object of this invention to provide a method and apparatus for manufacturing spent oil shale from surface retorting which has improved cementation properties and is suitable for disposal.

It is an object of this invention to provide a retorting process which enhances the conversion of inorganic carbonates to oxides and eliminates the need for a separate calcination step for the manufacture of improved spent shale.

SUMMARY OF THE INVENTION

The objects of this invention can be attained by an improved method and apparatus for the retorting of oil shale comprising passing feed comprising oil shale to a contacting zone wherein the feed oil shale is contacted with heat transfer medium to heat said shale to retorting temperature. The feed oil shale is substantially retorted to form fluid material having heating value and forming partially spent oil shale comprising inorganic and carbonaceous material. At least a portion of the partially spent oil shale is passed to a combustion zone wherein the partially spent oil shale is contacted with oxidizing gas comprising oxygen to substantially combust carbonaceous material and form spent oil shale. At least a portion of the spent shale is passed to a cooling zone to remove heat from the spent shale and at least a portion of the spent shale from the cooling zone is recycled by a recycle means to the contacting zone.

In one embodiment, the method comprises passing feed comprising crushed raw oil shale into a contacting zone wherein the feed oil shale is contacted with a heat transfer medium comprising spent oil shale to heat said feed oil shale to retorting temperature to about 400° C. to about 550° C. Retorting of the raw oil shale is substantially effected to form fluid material having heating value comprising shale oil and forming partially spent oil shale comprising inorganic material and carbonaceous coke. At least a portion of the partially spent oil shale is passed to a fluid bed combustion zone wherein the partially spent oil shale is contacted with oxidizing gas at a temperature from about 650° C. to about 800° C. to substantially combust the coke and form spent oil shale. At least a portion of the spent shale is passed to a cooling zone to remove heat from the spent shale and at least a portion of the spent shale from the cooling zone is passed to the contacting zone.

Feed oil shale is generally crushed to suitable size for contact with a heat exchange medium. It is generally desirable to crush the shale to a size sufficient to insure easy handling and rapid heat exchange. Some processes provide that the feed oil shale have a particle size less than about a one half of an inch in diameter while fluidized bed retorting may require somewhat smaller particle size.

The feed oil shale can have a wide range of kerogen content, often ranging from about 10 to about 90 gallons per ton by the Fischer Assay Technique. However, for surface retorting it is generally preferable to retort richer shales, such as those containing at least about 20 gallons per ton or higher.

The contacting zone can have a wide variety of configurations so long as the feed oil shale and the heat transfer medium undergo thorough mixing. Some of the preferred configurations for the contact zone comprise fluid beds, mechanical mixing devices such as screw mixers, rotating calciners, and transport reactors.

The heat transfer medium comprises hot gases, hot solids, or mixtures thereof, which are essentially chemically inert in the retorting environment. Gases generally are only a minor source of heat transfer. Preferably the heat transfer medium comprises hot spent oil shale.

Most oil shales begin to retort at temperatures in excess of about 350° C. In order to insure relatively fast retorting and minimize coke formation it is preferable to conduct retorting from about 400° C. to about 550° C. At substantially higher temperatures the shale oil undergoes excessive cracking and coke formation and reduces liquid yield.

The retorting takes place in the contacting zone or in a zone in conjunction with the contacting zone which provides suitable reaction time to effect substantial retorting. It is desirable to remove as much hydrocarbon from the rock as is economically feasible. Generally at least 80 percent of Fisher Assay is recovered and in some cases recovery in excess of 100 percent is possible. Even though the feed shale is substantially retorted, the partially spent shale from the retorting process will contain carbonaceous material such as coke. Coke is a carbonaceous material having a low hydrogen to carbon ratio and low solubility in most hydrocarbon solvents. After retorting it is very common for the partially spent shale to have coke on or in the inorganic matrix of the shale. Commonly partially spent shale will contain about 1 to about 10 weight percent carbon. The amount of carbon on partially spent oil shale is a function of shale type and richness, and retorting conditions such as temperature, contact time and heat transfer efficiency.

Retorting of oil shale can be conducted to provide a variety of fluid products, both gases and liquids. The mixture of gases and liquids can be varied somewhat by controlling or modifying reaction parameters especially temperature. Some of the products which are formed are shale oil; light hydrocarbon gases such as methane, ethane, ethene, propane, propene and the like; hydrogen; carbon dioxide; carbon monoxide; hydrogen sulfide; ammonia; and others. It is generally desirable to maximize liquid yield and minimize the amount of lower valued product gases formed.

Partially spent oil shale from the contact area and retorting zone is passed to a combustion zone where the carbonaceous material on or in the partially spent shale is oxidized. Most commonly combustion zones are fluidized beds or transport reactors wherein partially spent shale is contacted with an oxygen-containing gas to oxidize carbon to carbon dioxide and a minor amount of carbon monoxide. One preferable configuration for a combustion zone is an elongated upflow fluid bed wherein oxygen-containing gas is passed upwardly from near the bottom of the zone. The partially spent oil shale is introduced near the bottom of the combustion zone and maintained in the fluid state by a suitable gas velocity. Carbon on the particles is combusted as the particles pass upwardly. The temperature of the gases and solids rise substantially as they are passed upwardly. The combustion zone can be operated at temperatures in excess of about 650° C., preferably in the range of about 700° C. to about 800° C. At temperatures too low the oxidation of the carbon proceeds at too low a rate. At temperatures higher than 800° can cause sintering of the shale and also require special materials for the high temperature. At high temperatures exothermic reactions involving silica could result in uncontrolled temperature increases.

The oxidizing gas comprises an oxygen-containing gas such as air, or oxygen in conjunction with various diluents such as nitrogen, $CO_2$ and other gases. The oxygen containing gas generally comprises about 5 to about 25 mol percent oxygen, preferably about 10 to about 20 mol percent oxygen. It is also preferable for the oxidizing gas to contain steam which enhances the oxidation process and results in a spent shale having superior properties. Generally the gas feed to the oxidation zone comprises about 1 to about 75 mol percent, preferably about 25 to about 50 mol percent, steam.

After the partially spent shale is oxidized in the combustion zone spent oil shale is formed having an extremely low carbon content. Spent oil shale commonly has a carbon content less than about 0.5 weight percent, preferably less than 0.2 weight percent. At least a portion of the spent oil shale from the combustion zone is passed to the cooling zone. Generally, about 10 to about 100 weight percent, preferably about 30 to about 85 weight percent of the spent shale from the combustion zone is passed to the cooling zone.

About 10 to about 100 weight percent, preferably about 70 to about 100 weight percent of the spent shale from the cooling zone is passed to the contacting zone. Spent oil shale can be removed from the process downstream of the cooling zone for disposal; however, it is generally preferable to pass essentially all of the spent oil shale from the cooling zone to the contacting zone. The cooling zone reduces the temperature of the spent shale from the combustion zone by about 1° C. to about 100° C. Preferably, the cooling zone reduces the temperature of the spent shale by about 10° C. to about 50° C. The cooled shale which is still quite hot is passed to the contacting zone where it transfers heat to feed oil shale and heats the shale towards its retorting temperature.

Recycle rates depend on richness, temperature after cooling, and inorganic matrix composition but typically range from about 3–12 times the fresh feed rate, preferably about 4–8 times the fresh feed rate.

THE DRAWING

The attached drawing is a schematic representation of one of the embodiments of this invention.

Raw shale 1 crushed to a particle size of less than about a half inch in diameter is passed through line 2 to feed hopper 3. The feed hopper is a large container for storing a suitable amount of feed for the process 2. The crushed feed shale from feed hopper 3 is passed by gravity through valve 4 through line 5 where it is passed into one end of a mixing zone 6. This mixing zone contains a screw mixer 7 which is characteristic of a Lurgi-type process.

Hot spent shale from collecting bin 25 is passed through valve 80 through line 81 to mixing zone 6 where it is thoroughly mixed with raw feed shale and heats at least a portion of the feed to retorting temperature. Much of the retorting takes place within mixing zone 6. However, because of relatively short residence times, the mixture of hot spent shale and partially retorted shale or feed shale passes from the end of the contacting zone through line 20 into surge bin 21 where additional contact time and retorting occurs. Because of the relatively high temperatures involved, retorting at about 400° C. to about 550° C., the oil formed is in the vapor state. The oil in the gaseous state and light hydrocarbons, hydrogen sulfide, ammonia and various other off gases pass through line 8 to cyclone separator 9 for the partial removal of finely divided dust and spent shale. The product stream passes through line 10 to another cyclone separator 11 for further purification and then on through line 12 to recovery 13. The separated dust (spent and/or partially spent shale) from cyclone 9 can be passed through line 60, valve 61, line 62, valve 63 and line 64 for disposal 65 or alternatively back to the surge bin 21. The separated dust from cyclone 11 can be passed through line 66, valve 67, and line 68 for recycle back to surge bin 21. Surge bin 21 is also provided with line 85 to remove additional gaseous products back to line 8 for purification and product recovery. The surge bin 21 contains a mixture of partially spent shale from retorting and also finely divided spent shale which was used as a heat transfer medium. Some of this mixture from the bottom of surge bin 21 can be removed through line 86, through valve 87 and line 88 and passed to disposal 65. However, the mixture from surge bin 21 generally passes through line 22 and valve 33 and line 34 to near the base of an elongated vertical lift pipe combustion zone 24. Air, preferably in conjunction with steam, is provided through line 90 through valve 91 and line 76 for blending with steam 71 which is passed through line 73, valve 75 and line 77 where it is combined with the air. The air and steam are combined in line 78 and passed into the base of the lift heater. The velocity of this mixture of air and steam is sufficient to pass the solids from line 34 upwardly through the lift pipe at a velocity sufficient to lift and transport the solids to the top of the lift pipe, and substantially effect combustion of the carbonaceous material on or in the inorganic matrix. Oxidation gases comprise air plus about 5 to about 50 mole percent steam. The mixture of combustion gases and spent shale is passed into a collecting bin 25 where a portion of the spent shale is collected for recirculation back to the mixing zone 6. The collecting bin also provides line 82, valve 51 and line 52 to provide for the passage of spent shale to disposal 65. It is preferable to transport most fines with flue gas for heat recovery. Gases from the lift pipe are passed through collecting bin 25 through line 26 to cyclone 27 for separation of finely divided spent shale from gases. This cyclone may be run to remove no solids, except in the case of low solids inventory in the heat transfer system. Gases and solids are passed through line 40 to an off gas clean up process and heat recovery 41. Commonly the off gas clean up will encompass some heat exchange and electrostatic precipitators to remove very finely divided spent shale. When cyclone 27 is operational, dust is passed through valve 28 either for recycle to mixing zone 6 through line 50 or through line 29, valve 30 and line 31 for disposal 32. Introduction of steam 71 at the base of lift heater 24 also provides for humidification of the off gas stream passing through line 40 which will aid in the removal of very finely divided dust by electrostatic precipitators.

Collecting bin 25 contains cooler 94 which provides for the cooling of spent shale from combustion zone 24. The spent shale is cooled by about 1° to about 100° C., preferably from about 10° to about 50° C. in the cooling zone. The cooled spent shale can be recycled through valve 80 and line 81 to contacting zone 6 for contact with feed oil shale.

The cooling zone can contain several sections of pipe through which a coolant, such as air, water or steam, is circulated to reduce spent shale temperature.

Cooler 94 can also be positioned in the line connected collecting bin and screw mixer 6. In this case, less than 100 percent of the spent shale will pass into the cooling zone.

Hot flue gas from line 26, cyclone 27, and line 40 pass to heat exchanger 89 which is used to preheat feed air for the combustion zone 24. Off-gases from heat exchanger 89 are passed through line 96 to high pressure steam generator 97 and through line 98 to disposal 99.

Compressor 83 provides air through line 84 to heat exchanger 89 where it is used to recover heat from off-gases and also be preheated itself for use in combustion zone 24. Compressor 83 also passes air through lines 84 and 93 to cooling zone 94 for the cooling of spent shale and also for the preheating of the air for use in the combustion zone. Preheated air from zones 89 and 94 are passed through lines 90 and 95, respectively, through valve 91 and line 76 for introduction near the bottom of elongated combustion zone 24. Steam is preferably mixed with the preheated air in line 78 to provide a more suitable environment for oxidation and carbonate conversion within the oxidation/combustion zone.

I claim:

1. An improved method for retorting oil shale, comprising the steps of:

(a) separately feeding raw oil shale and cooled spent oil shale to a retort defining a contacting zone;

(b) contacting said raw oil shale with said cooled spent oil shale in said contacting zone for a sufficient time at a retorting temperature of about 400° C. to about 550° C. to liberate light hydrocarbon gases and shale oil from said raw oil shale leaving retorted oil shale containing carbonaceous material;

(c) passing at least a portion of said retorted and spent oil shale to a substantially vertical lift pipe defining a combustion zone;

(d) injecting an oxidizing gas into said lift pipe to substantially combust said carbonaceous material on said retorted oil shale forming spent oil shale and transporting said spent oil shale generally upwardly through said lift pipe into a collection bin, said combustion heating said spent oil shale to a temperature ranging from 650° C. to 800° C. and emitting combustion off gases;

(e) cooling at least a portion of said heated spent oil shale in said collecting bin from 1° C. to 100° C. by circulating a coolant selected from the group consisting essentially of air, water and steam through sections of pipe in said collecting bin, said coolant cooling said heated spent oil shale to form cooled spent oil shale for use in steps (a) and (b), and said heated spent oil shale heating said coolant leaving heated coolant;

(f) feeding air into a heat exchanger located upstream of said collecting bin and downstream of said lift pipe;

(g) recovering heat from said combustion off gases while simultaneously preheating said feed air by passing said combustion off gases through said heat exchanger in heat exchange relationship with said feed air;

(h) heating said preheated air by feeding said heated coolant into said preheated air downstream of said heat exchanger to form at least part of said oxidizing gas for use in step (d); and (i) feeding steam into said oxidizing gas before said oxidizing gas is injected into said lift pipe;

(j) said injected oxidizing gas containing from 25 mol % to 50 mol % steam.

2. The method of claim 1 wherein said spent oil shale is substantially separated from said combustion off gases in a cyclone before said combustion off gases are passed to said heat exchanger.

3. The method of claim 1 wherein steam is circulated through said pipe sections in said collecting bin for use as said coolant.

4. The method of claim 1 wherein water is circulated through said pipe sections in said collecting bin for use as said coolant.

5. The method of claim 1 wherein: said heated spent oil shale is cooled from 10° C. to 50° C. in said collecting bin from said coolant in said sections of pipe; and from 10% to 100% by weight of said cooled spent oil shale is fed to said retort defining said contacting zone.

6. The method of claim 5 wherein at least 70% by weight of said cooled spent oil shale is fed to said retort defining said contacting zone.

7. The method of claim 1 wherein said cooled spent oil shale is fed to a fluid bed retort.

8. The method of claim 2 wherein said separated spent oil shale is recycled from said cyclone to said retort.

9. An improved apparatus for retorting oil shale, comprising:

a retort defining a contacting zone for retorting raw oil shale in the presence of cooled spent oil shale;

raw feed means for said feeding raw oil shale into said retort;

spent shale feed means for feeding said cooled spent oil shale into said retort and for substantially preventing said cooled spent oil shale from contacting said raw oil shale before entering said retort;

a substantially vertical lift pipe defining a combustion zone;

combustor feed means for feeding retorted and spent oil shale from said retort to said lift pipe;

a collecting bin disposed generally above and in communication with said lift pipe;

injector means for injecting an oxidizing gas into said lift pipe to combust and heat said retorted and spent oil shale in said combustion zone leaving heated spent oil shale and emitting combustion off gases and to lift said heated spent oil shale generally upwardly through said lift pipe into said collecting bin;

first heat exchanger means operatively associated with said collecting bin for cooling said heated spent oil shale with a coolant selected from the group consisting essentially of air, water and steam, and for heating said coolant with said spent oil shale;

coolant means for feeding said coolant to said first heat exchanger means;

second heat exchanger means located downstream of said collecting bin and upstream of said lift pipe for recovering heat from said combustion off gases and for preheating feed air;

air means for feeding said feed air to said second heat exchanger;

means for feeding said heated coolant into said preheated feed air to form at least part of said oxidizing gas; and cyclone means operatively positioned between said collecting bin and said second heat exchanger means for separating spent oil shale from said combustion off gases before heat is recovered from said combustion off gases in said second heat exchanger means.

10. An improved apparatus for retorting oil shale in accordance with claim 9 wherein said coolant consists essentially of air and said coolant means includes said air means and comprises a compressor for feeding air directly to said first heat exchanger means and to said second heat exchanger means for use as said coolant.

11. An improved apparatus for retorting oil shale in accordance with claim 9 including steam injector means for injecting steam into said oxidizing gas after said heated coolant has been fed into said preheated feed air and before said oxidizing gas is injected into said life pipe.

12. An improved apparatus for retorting oil shale in accordance with claim 9 wherein said first heat exchanger means includes sections of pipe in said collecting bin for circulating said coolant in said collecting bin.

13. An improved apparatus for retorting oil shale in accordance with claim 4 wherein said first heat exchanger defines a cooler located between said collecting bin and said retort.

* * * * *